United States Patent [19]

Herpers, Jr. et al.

[11] 4,014,808

[45] Mar. 29, 1977

[54] DETERGENT COMPOSITION

[75] Inventors: Ferdinand J. Herpers, Jr., Minnetonka; Daniel I. Untiedt, Crystal, both of Minn.

[73] Assignee: Tennant Company, Minneapolis, Minn.

[22] Filed: Sept. 4, 1975

[21] Appl. No.: 610,264

Related U.S. Application Data

[63] Continuation-in-part of Ser. No. 366,441, June 4, 1973, abandoned.

[52] U.S. Cl. ..... 252/135; 252/156; 252/525; 252/528; 252/DIG. 2; 252/DIG. 3

[51] Int. Cl.[2] ..... C11D 3/066

[58] Field of Search ..... 252/135, 528, DIG. 2, 252/DIG. 3, DIG. 15, 525, 527, 156

[56] References Cited

UNITED STATES PATENTS

| | | | |
|---|---|---|---|
| 3,288,770 | 11/1966 | Butler | 260/29.7 R |
| 3,360,470 | 12/1967 | Wixon | 252/99 |
| 3,721,633 | 3/1973 | Ranauto | 252/135 X |
| 3,849,327 | 11/1974 | DiSalvo et al. | 252/532 X |

FOREIGN PATENTS OR APPLICATIONS

| | | | |
|---|---|---|---|
| 991,980 | 12/1962 | United Kingdom | 252/135 |

*Primary Examiner*—Thomas J. Herbert, Jr.
*Attorney, Agent, or Firm*—Orrin M. Haugen

[57] ABSTRACT

A detergent composition particularly useful in aqueous solutions for cleaning soiled surfaces. The formulation which may be in either dry or concentrate form, includes alkaline builders, wetting agents, and a flocculant, and may in certain instances, include a floatation agent. As an alkaline builder, sodium tripolyphosphate is normally preferred, while others such as mixtures of sodium tripolyphosphate with sodium sulphate or potassium hydroxide and soda ash may also be successfully utilized. The formulation is preferably applied to the surface as an aqueous solution in relatively heavy or thick layers, with agitation to permit the removed soilage to create flocs, and with the flocculated soilage being floated away from contact with the surface for facilitating removal.

11 Claims, No Drawings

DETERGENT COMPOSITION

CROSS-REFERENCE TO RELATED APPLICATION

The present application is a Continuation-in-Part of our co-pending application Ser. No. 366,441, filed June 4, 1973 and entitled "DETERGENT COMPOSITION," now abandoned.

BACKGROUND OF THE INVENTION

The present invention relates generally to an improved detergent formulation or composition, and more specifically to such a formulation which has been found particularly useful in an aqueous working solution for the treatment of soiled floor surfaces. The formulation is particularly useful in that certain apparatus for cleaning floor surface disclosed and claimed in co-pending application Ser. No. 188,760, filed Oct. 13, 1971, and entitled "SURFACE CLEANING METHOD AND MACHINE", and assigned to the same assignee as the present invention, now U.S. Pat. No. 3,753,777 dated Aug. 21, 1973.

The formulations of the present invention normally employ one or more alkaline builders, a wetting agent, and a flocculant, with a floatation agent being optionally present. The function of the working solution prepared from the composition is to initially remove surface soilage from floors or other surfaces, and upon undergoing sufficient agitation, the removed soilage will form flocs in the solution, whereupon the residual solution may be removed from the surface by a conventional squeegee or the like and thereafter transferred to a receiving tank or vessel. Agitation may in certain systems by violent to achieve flocculation. If desired, a simple filter may be employed to separate the flocculated soilage and other solids from the returned solution for ultimate recycling.

SUMMARY OF THE INVENTION

The formulation of the present invention is compatible with water, and is capable of forming a stable working solution. Furthermore, the wetting agents which are employed are compatible with the remaining components of the formulation and hence a stable composition is available. The flocculating agent is present in order to provide a basis for coagulation of soilage, the soilage being then rendered in a form which is readily adapted for retrieval and filtration.

It will be appreciated that filtration is the desirable method for separating the solid particles from the liquid. While various types of centrifugal separators such as hydroclones or the like may be employed, a substantial portion of the solids normally present have density and surface characteristics which eliminate centrifugal type separators from serious consideration.

Normal filtering techniques are difficult to successfully employ when filtering ordinary partially used or spend working solutions which have been used in floor cleaning or scrubbing because of the extremely small size of the solid particles. The pores of normal surface or depth-type filters become clogged and thus render it necessary to frequently clean or change the active element of the filter. In addition, the extremely fine particle size of the solids makes it necessary to utilize substantial quantities of power to move the solution through the filter because of the high pressure drop normally involved. With a fluocculating agent present, however, these extremely fine particles may be combined with the agent in the form of a floc, thereby rendering the solution susceptible to normal filtering operations.

The present invention makes available a working solution which is highly effective in removing soilage from floors and other surfaces, and which is also highly effective in floating and/or flocculating this soilage within an applied aqueous layer or film of the solution. Accordingly, it is now possible to employ the formulation in scrubbing machines having a single reservoir or tank for retaining the working solution, with the partially used or partially spent solution being recycled through the apparatus for solids removal, with the cleaned or filtered solution being ultimately returned to the reservoir or tank for re-use. Because of the capability of utilizing this procedure, down-time on the scrubbing machine is substantially reduced inasmuch as a greater quantity of working solution can be taken on board the unit at start-up time, and the recycling feature extends the range for the quantity of useful solution and provides an effective storage vessel of substantial magnitude. Furthermore, the need for a second vessel for recovered spent solution is eliminated and this volume may be utilized for initial and continued retention of usable working solution.

Because of the quantity of flocculating agent present, the solution has a significant dirt-holding capacity. The flocs are durable and lack any significant tendency toward breaking up. The cloud point of the wetting agents employed is normally high for optimum results, such as in the range of 100° C. or higher, thus the solutions normally are relatively clear, without substantial cloudiness, and do not take on the appearance of an emulsion and do not deteriorate prior to use due to the presence of particles in the clean working solution. Also, the wetting agent is compatible in alkaline solutions such as may be utilized here.

The formulation finds utility in working solutions with a wide range of concentrations, including those with an extremely low dilution. For example, the formulation of the present invention may function in a working solution at dilutions as low as about 2 to 5% with water or greater.

The formulation is also universally adapted for use in connection with a wide variety of soils, including black dirt, clays, AC fine dust which is used as a standard in SAE Air Cleaner Test Code J-726, cement dust, animal fat soilage and lubricating oils as well as graphite grease soilage.

Therefore, it is a primary object of the present invention to provide an improved detergent formulation for use in connection with the cleaning of floor and other soiled surfaces, wherein the formulation includes a combination of alkaline builders, wetting agents, and a flocculant, all of which are present to prepare a synergistic system which provides improved cleaning and improved floatation of removed soilage.

It is yet a further object of the present invention to provide an improved detergent composition useful in the cleaning of soiled surfaces and which is based upon a system including alkaline builders, wetting agents and a flocculant, and also a floatation agent, wherein the system is particularly adapted for application in relatively thick liquid layers upon surfaces, and wherein the applied layer is subjected to agitation, preferably violent agitation, in order to remove soilage from the surface, and also to retain removed soilage in the solution in the form of a floc.

It is yet a further object of the present invention to provide an improved detergent composition which is particularly useful in the cleaning of soiled surfaces, and wherein the solution is applied to the surface to be cleaned in a relatively thick surface layer or film, agitated while in contact with the surface, with the residue thereafter being removed from the surface and filtered in order to remove the formed flocs therefrom.

It is yet another object of the present invention to provide an improved detergent composition particularly useful in the cleaning of soiled surfaces wherein the formulation may be applied to the soiled surface, removed, screened, and re-used for a plurality of cycles without significant loss of effectiveness under ordinary soil conditions.

Other and further objects of the present invention will become apparent to those skilled in the art upon a study of the following specification and appended claims.

DESCRIPTION OF THE PREFERRED EMBODIMENT

In order to describe the various aspects of the present invention including the preferred embodiment, the following examples are provided:

EXAMPLE 1

A detergent concentrate having the following formulation was prepared:

| Component | Content |
|---|---|
| Sodium Tripolyphosphate | 7% |
| Potassium Hydroxide | 5.3% |
| Soda ash (light) | 2.2% |
| Non-ionic water soluble alkylated surfactant | 1.5% |
| Flocculant, Polydiallyldimethyl ammonium chloride (average molecular weight 100,000 in 40% solids solution) | 14% |
| Water | 70% |

This formulation has a pH of from 11.6 to 12.0, and may be used in water in any effective dilution range depending upon the amount of dirt present, with dilutions ranging from between about 5 and 15% being normally preferred. The surfactant utilized is a mixture of mono and polyglucosides of a mixed alcohol having from 8 to 10 carbon atoms and available from Rohm & Haas Co. of Philadelphia, PA under the designation "Triton BG-10." The dirt holding capacity of the working solution has been found to be greater than 35 times the weight of the polyelectrolyte present.

The formulation set forth in this example may be packaged on a single package basis, and thus may be made available for use by adding to a suitable quantity of water.

The mutual compatibility of the compounds in the solution provides a greater dirt flocculating capacity, wherein the dirt and soilage is flocculated at a rapid rate and floatation occurs likewise at a rapid rate. The flocs are strong and easily filtered, and capable of withstanding the forces normally present in simple filters, either of the surface or depth type.

If a solution becomes substantially spent due to the removal of soilage, and the capacity of flocculate is deteriorating, more flocculant, detergent and/or floatation agent may be metered into a given solution in order to replenish the solution to cause flocculation and clean-up upon continued use.

EXAMPLE 2

A detergent concentrate having the following formulation was prepared:

| Component | Content |
|---|---|
| Sodium Tripolyphosphate | 7% |
| Sodium Sulfate | 1.9% |
| Soda ash (light) | 1.9% |
| Non-ionic alkylated surfactant | 1% |
| Floatation agent, Sodium Alkyl Aryl Sulfonate | 1.6% |
| Flocculant, Polydiallyldimethyl ammonium chloride (average molecular weight 100,000 in 40% solids solution) | 11% |
| Water | 77% |

The formulation has a pH of from 10.6 to 10.8 and is recommended for use in water with any effective range, depending upon the amount of dirt present, preferably in a dilution ratio of 10%. The surfactant is nonylphenoxypoly (ethyleneoxy) ethanol available from GAF Corporation of New York, NY under the designation "Igepal CO-630." The dirt holding capacity of the working solution is approximately 35 times the weight of the polyelectrolyte present.

EXAMPLE 3

A detergent concentrate having the following formulation was prepared:

| Component | Content |
|---|---|
| Sodium Tripolyphosphate | 10% |
| Potassium Hydroxide | 4.3% |
| Soda ash (light) | 2.2% |
| Surfactant as in Example 1 | 4.5% |
| Flocculant, Polydiallyldimethyl ammonium chloride (average molecular weight 100,000 in 40% solids solution) | 17% |
| Water | 62% |

This formulation provides a pH substantially the same as that in Example 1 and is used in substantially the same dilution ratio. The dirt holding capacity is enhanced on an absolute basis because of the increase in the quantity of polyelectrolyte present.

EXAMPLE 4

A detergent concentrate having the following formulation was prepared:

| Component | Content |
|---|---|
| Sodium Tripolyphosphate | 5% |
| Potassium Hydroxide | 6.3% |
| Soda ash (light) | 5.2% |
| Surfactant as in Example 1 | 1.5% |
| Flocculant, Polydiallyldimethyl ammonium chloride (average molecular weight 100,000 in 40% solids solution) | 10% |
| Water | 72% |

This formulation has a pH of approximately 12, and is available for dilution ratio in water in any effective range depending upon the amount of dirt present, preferably in an amount of about 5%. Other dilution ratios, such as up to about 15% may also be employed.

EXAMPLE 5

A detergent concentrate having the following formulation was prepared:

| Component | Content |
|---|---|
| Sodium Tripolyphosphate | 10% |
| Sodium Sulfate | 4.9% |
| Soda ash (light) | 2.9% |
| Surfactant as in Example 2 | 2.5% |
| Floatation agent, Sodium Alkyl Aryl Sulfonate | 2.6% |
| Flocculant, Polydiallyldimethyl ammonium chloride (average molecular weight 100,000 in 40% solids solution) | 10% |
| Water | 67.1% |

This formulation provides a pH of about 10.5 and is recommended for use in any effective range depending upon the amount of dirt present, preferably in a dilution ratio of 10% in water, although higher concentrations, such as up to about 20% may be employed.

In the formulations, the sodium tripolyphosphate is employed as a cleaning agent. Its function is to neutralize acidic soils present in the surfaces being cleaned. Furthermore, sodium tripolyphosphate contributes to the emulsification properties of the detergent and contributes to water softening through sequestration.

EXAMPLE 6

A detergent concentrate having the following formulation was prepared:

| Component | Content |
|---|---|
| Trisodium Phosphate | 7% |
| Potassium Hydroxide | 5.3% |
| Soda ash (light) | 2.2% |
| Surfactant as in Example 1 | 1.5% |
| Flocculant, Polydiallyldimethyl ammonium chloride (average molecular weight 100,000 in 40% solids solution) | 14% |
| Water | 70% |

This formulation has a pH of about 12.0 and may be used in water in any effective range depending upon the amount of dirt present, preferably in a dilution ranging from between about 5 and 15%. The dirt holding capacity of the working solution has been found to be greater than 35 times the weight of the polyelectrolyte present.

The formulation set forth in this example may be packaged on a single package basis, and thus may be made available for use by adding to a suitable quantity of water, wherein a true solution is provided.

EXAMPLE 17

A detergent concentrate having the following formulation was prepared:

| Component | Content |
|---|---|
| Tetrasodium Pyrophosphate | 7% |
| Potassium Hydroxide | 5.3% |
| Soda ash (light) | 2.2% |
| Surfactant as in Example 1 | 1.5% |
| Flocculant, Polydiallyldimethyl ammonium chloride (average molecular weight 100,000 in 40% solids solution) | 14% |

-continued

| Component | Content |
|---|---|
| Water | 70% |

This formulation has a pH of from about 11.8 to 12.2 and may be used in water in any effective range depending upon the amount of dirt present, preferably in a dilution ranging from between about 5 and 15%. The dirt holding capacity of the working solution has been found to be greater than 35 times the weight of the polyelectrolyte present.

The formulation set forth in this example may be packaged on a single package basis, and thus may be made available for use by adding to a suitable quantity of water, wherein a true solution is provided.

EXAMPLE 8

A detergent concentrate having the following formulation was prepared:

| Component | Content |
|---|---|
| Tetrapotassium Pyrophosphate | 7% |
| Potassium Hydroxide | 5.3% |
| Soda ash (light) | 2.2% |
| Surfactant as in Example 1 | 1.5% |
| Flocculant, Polydiallyldimethyl ammonium chloride (average molecular weight 100,000 in 40% solids solution) | 14% |
| Water | 70% |

This formulation has a pH of about 11.8, and may be used in water in any effective range depending upon the amount of dirt present, preferably in a dilution ranging from between about 5 and 15%. The dirt holding capacity of the working solution has been found to be greater than 35 times the weight of the polyelectrolyte present.

The formulation set forth in this example may be packaged on a single package basis, and thus may be made available for use by adding to a suitable quantity of water, wherein a true solution is provided.

EXAMPLE 9

A detergent concentrate having the following formulation was prepared:

| Component | Content |
|---|---|
| Sodium Hydroxide | 7% |
| Potassium Hydroxide | 5.3% |
| Soda ash (light) | 2.2% |
| Surfactant as in Example 1 | 1.5% |
| Flocculant, Polydiallyldimethyl ammonium chloride (average molecular weight 100,000 in 40% solids solution) | 14% |
| Water | 70% |

This formulation has a pH of about 12, and may be used in water in any effective range depending upon the amount of dirt present, preferably in a dilution ranging from between about 5 to 15%. The dirt holding capacity of the working solution has been found to be greater than 35 times the weight of the polyelectrolyte present.

The formulation set forth in this example may be packaged on a single package basis, and thus may be made available for use by adding to a suitable quantity of water, wherein a true solution is provided.

EXAMPLE 10

A detergent concentrate having the following formulation was prepared:

| Component | Content |
|---|---|
| Sodium Tripolyphosphate | 65% |
| Soda ash (light) | 10% |
| Surfactant as in Example 1 | 5% |
| Flocculant, Polydiallyldimethyl ammonium chloride (average molecular weight 100,000 in 40% solids solution) | 20% |

This formulation provides a working solution having a pH of about 11.0, and may be used in water in any effective range depending upon the amount of dirt present, preferably in a dilution ranging from between about 1.5 and 15%. The dirt holding capacity of the working solution has been found to be greater than 35 times the weight of the polyelectrolyte present.

The formulation set forth in this example may be packaged on a single package dry basis, and thus may be made available for use by adding to a suitable quantity of water at the desired dilution, and the working solution is thereby provided.

EXAMPLE 11

A detergent concentrate having the following formulation was prepared:

| Component | Content |
|---|---|
| Trisodium Phosphate | 64% |
| Soda ash (light) | 10% |
| Surfactant as in Example 1 | 5% |
| Flocculant, Polyacrylamide (average molecular weight 2–15 million in 40% solids solution) | 20% |
| Ferric Chloride | 1% |

This formulation provides a working solution having a pH of about 12.0, and may be used in water in a dilution ranging from between about 1.5 and 15%, depending upon the amount of dirt present. The dirt holding capacity of the working solution has been found to be greater than 35 times the weight of the polyelectrolyte present.

The formulation set forth in this example may be packaged on a single package dry basis, and thus may be made available for use by adding to a suitable quantity of water, thereby providing a useful working solution.

EXAMPLE 12

A dry detergent concentrate having the following formulation was prepared:

| Component | Content |
|---|---|
| Tetrasodium Pyrophosphate | 30% |
| Sodium Tripolyphosphate | 35% |
| Soda ash (light) | 10% |
| Surfactant as in Example 1 | 5% |
| Flocculant, Polydiallyldimethyl ammonium chloride (average molecular | |

-continued

| Component | Content |
|---|---|
| weight 100,000 in 40% solids solution) | 20% |

This formulation provides a working solution having a pH of about 12.0, and may be used in water in a dilution ranging from between about 1.5 and 15%, with the entire range being effective. The dirt holding capacity of the working solution has been found to be greater than 35 times the weight of the polyelectrolyte present.

The formulation set forth in this example may be packaged on a single dry package basis, and thus may be made available for use by adding to a suitable quantity of water, with a useful working solution being provided.

EXAMPLE 13

A detergent concentrate having the following formulation was prepared:

| Component | Content |
|---|---|
| Sodium Tripolyphosphate | 7% |
| Potassium Hydroxide | 5.3% |
| Soda ash (light) | 2.2% |
| Surfactant as in Example 2 | 1.5% |
| Flocculant (natural type, Gaur gum) | 3% |
| Water | 81% |

This formulation provides a working solution having a pH of about 11.5 and may be used in water in a dilution ranging from between about 5 and 15%. The dirt holding capacity of the working solution has been found to be about 35 times the weight of the flocculant present.

EXAMPLE 14

A detergent concentrate having the following formulation was prepared:

| Component | Content |
|---|---|
| Sodium Tripolyphosphate | 7% |
| Potassium Hydroxide | 5.3% |
| Soda ash (light) | 2.2% |
| Surfactant as in Example 1 | 1.5% |
| Flocculant, a cationic polyamine (available from Dow Chemical Corp. of Midland, Michigan under the code name "Purifloc C-31") | 14% |
| Water | 70% |

This formulation has a pH of about 11.8 and may be used in water in any effective range depending upon the amount of dirt present, preferably in a dilution ranging from between about 5 and 15%. The dirt holding capacity of the working solution has been found to be greater than about 35 times the weight of the polyelectrolyte flocculant present.

EXAMPLE 15

A first portion of a detergent concentrate was prepared having the following formulation:

| Component | Content |
|---|---|
| Sodium Tripolyphosphate | 5% |
| Potassium Hydroxide (water 40%) | 4% |
| Soda ash (anhydrous) | 8% |

-continued

| Component | Content |
|---|---|
| Sodium Metasilicate (Pentahydrate) | 3% |
| Surfactant, (an anionic modified ethoxylate, biodegradable, available from Rohm & Haas of Philadelphia, Pennsylvania under the code name "Triton DF-20") | 2% |
| Water | 78% |

Mixing Procedure

The water is introduced into a mixing tank equipped with an agitator and heating coil. The dry components are then added and agitated until dissolved. The various alkaline solutions are then added and the surfactant added thereafter. The mixture is rapidly agitated until the slightly straw-colored mixture becomes homogeneous and clear. Some exothermic reaction may occur, and a mixing temperature of about 43° C. is preferred.

Flocculant

A flocculating component for addition to the detergent is then prepared having the following formulation:

| Component | Content |
|---|---|
| Polydiallyldimethyl-ammonium chloride of average molecular weight of between about 250,000 and 300,000 | 50% |
| The copolymer of dimethyl diallyl ammonium chloride and acrylamide with a molecular weight in excess of one million (commercially available from Calgon Corporation of Pittsburgh, Pa. under the code name "WT-2640" and "WT-2860"). | 50% |

The flocculant may be mixed with water on a 50:50 basis so as to provide a pre-mixed flocculant which is then, in turn, added to the detergent concentrate in a concentration ranging from between 2 to 40% (dry basis), balance alkaline builder and wetting agent. Preferably, the flocculant is arranged so as to be present in the soilage in an amount ranging from between 300 ppm and 700 ppm. However, from between about 200 ppm and 2000 ppm may be found useful.

In addition, a coagulant aid may be utilized, the coagulant aid being bentonite clay and present in an amount of up to about 5% by weight. As will be appreciated, the coagulant aid is not required for all applications.

The working solutions preferably contain 2% by weight of the detergent portion. Working solutions containing up to about 5% by weight of detergent may be required for heavy soilage conditions.

EXAMPLE 16

The detergent portion of the concentrate of Example 15 was prepared and used in combination with a flocculant having the following formulation:

| Component | Content |
|---|---|
| Polydiallyldimethyl-ammonium chloride of average molecular weight of about 100,000 (40% solids solution) | 20% |

This flocculant was employed in the detergent portion, with the balance of 80% consisting of the builder and wetting agent.

The method of preparing the solution was followed as set forth in connection with Example 15.

EXAMPLE 17

A detergent concentrate having the following formulation was prepared:

| Component | Content |
|---|---|
| Sodium Tripolyphosphate | 5% |
| Potassium Hydroxide (40% aqueous solution) | 4% |
| Soda ash (anhydrous) | 8% |
| Sodium Metasilicate | 3% |
| Surfactant as in Example 1 | 2% |
| Water | 78% |

This detergent concentrate was then added to the flocculant formulation of Example 15. The combined formulation may be used in water in an effective range of working solutions, preferably in a dilution ranging from between about 2 and 10%. The dirt holding capacity of the working solution has been found to be greater than about 35 times the weight of the polyelectrolyte flocculant present.

EXAMPLE 18

A detergent concentrate having the following formulation was prepared:

| Component | Content |
|---|---|
| Sodium Tripolyphosphate | 5% |
| Potassium Hydroxide (40% aqueous solution) | 4% |
| Soda ash (anhydrous) | 8% |
| Sodium Metasilicate | 3% |
| Surfactant as in Example 2 | 2% |
| Water | 78% |

This detergent concentrate was then added to the flocculant formulation of Example 15. The combined formulation may be used in water in an effective range of working solutions, preferably in a dilution ranging from between about 2 and 10%. The dirt holding capacity of the working solution has been found to be greater than about 35 times the weight of the polyelectrolyte flocculant present.

GENERAL COMMENTS

Potassium hydroxide is employed as a source of high alkalinity and when present in the solution, provides a pH buffer (Examples 1, 3 and 4). When acidic soils are contacted by the solution, the pH level is maintained elevated even after exposure to substantial quantities of such soils. One further feature of the potassium hydroxide is its enhancement of the interfacial activity of the wetting agent when employed, this material acting to saponify fatty soils readily soluble.

Sodium carbonate (soda ash) is used as an alkaline builder that offers significant saponification properties as well as certain water softening properties to the formulation. Because of its elevated pH in solutions, it functions to neutralize acid soils and reinforce the alkalinity in the formulation.

Among other alkaline builders and alkalinity agents that may find utility in the present formulations are the following:

Trisodium phosphate
Tetrasodium pyrophosphate
Tetrapotassium pyrophosphate
Sodium hydroxide Examples of these in formulations are set forth hereinabove. In the formulations, the alkaline builders are employed as a cleaning agent. Their primary function is to neutralize acidic soils present in the surfaces being cleaned. Furthermore, these materials normally contribute to the emulsification properties of the detergent.

The surfactant is a water soluble type as described in the examples and may be either non-ionic, as indicated, or may be anionic and supplied in acid form. These materials are commercially available and are known for their surfactant properties. The primary function of this component in the solution is to improve the wetting power of the water. Improvement of the wetting power permits a more complete and rapid penetration of the alkaline solution into and around the soils, thus reducing the mechanical energy which otherwise would be needed to separate the soil from the surface.

The surfactant normally possesses a wide temperature range cloud dispersion point. Certain non-ionic surfactants having a narrow range of cloud dispersion points may be suitable provided the working range is limited to the stable range. It has been found that the use of a hydrotrope which is compatible with the wetting agent may increase the cloud dispersion point so as to provide a greater workable range. The surfactants or wetting agents preferably are, as indicated, either non-ionic or acid-based anionic type and also preferably have a cloud dispersion point such that the materials remain stable in solution within the working conditions. For example, cloud dispersion points ranging from between 0° and above 100° C. may be required. In certain applications, surfactants such as octyl and nonyl phenoxy polyethoxy ethanol may be employed. Also, a biodegradable modified ethoxylate may be employed, with the ethoxylate being an intermediate-acid form surfactant reactive in alkaline solutions to form a stable component.

In certain formulations having a pH which lies for example at about 10 and below, cationic type wetting agents may be employed. Cationic type surfactants are compatible with cationic flocculants such as are employed in the present formulations. Except for the intermediate-acid form of surfactant, because of the apparent incompatibility of opposite ionic character between flocculants and surfactants, conventional anionic surfactants are normally not as workable in single package systems, containing cationic polyelectrolytes. The wetting agents are, as indicated, preferably non-ionic or acid-based anionic types and preferably have a cloud dispersion point such that the materials remain stable in solution within the working conditions.

The flocculant is a polyelectrolyte, preferably a high molecular weight cationic polyelectrolyte which causes soilage to agglomerate rather than disperse. In the formulations, it has been found that the formed flocs will float upon agitation, thus providing a clearer residual floor surface and allowing filtering of the solids from the solution.

among the polyelectrolytes which may be utilized are the following:

Polyacrylonitriles
Polyacrylamides
Copolymers of dimethyl diallyl ammonium chloride and acrylamide
Polyacrylic acid and its salts
Polyamide having a carboxylic group
Polyamines
Polyethylene oxide
Sodium carboxymethylcellulose
Sulfonated polymers Certain natural occurring materials may also be included in the list of flocculants which may be found useful, these being the natural occurring materials as follows:

Bentonite clay
Guar gums (polysaccharides)
Leguminous seed derivatives
Sea weed derivatives (or algin and its salts)
Starch derivatives and modified starches As has been indicated, the materials are preferably cationic types which are compatible with the alkaline builders and they may be employed in lieu of the flocculant employed in the examples.

The precise function or operation of flocculation utilizing a high molecular weight polyelectrolyte, either a natural occurring substance or a synthetic substance, is not fully understood. A variety of theories have been advanced from time to time, each expressing a proposed or theoretical mode of operation. Two basic premises appear to exist for most theories, that is, when the polyelectrolyte is highly ionic in nature, it may function by charge neutralization on the charged particles which are in the suspension, thereby permitting them to agglomerate. On the other hand, polyelectrolytes of very high molecular weight may become physically adsorbed on two or more particles per molecule, this adsorption phenomena normally being termed "bridging". The neutralization of electrical charges on the adsorbed polyelectrolyte molecules then may cause it to coil and to become physically inmeshed with agglomerates of other molecules with similar particle holding characteristics, thus contributing to the flocculation operation.

The cationic flocculant agents are normally preferred because of their tendency to raise the flocculant to the top of the layer of solution applied to the surface being treated. Anionic type flocculants normally do not possess the tendency toward floatation in the working solutions prepared in accordance with the present invention. It will be appreciated, of course, that compatible anionic flocculants may be employed as effective ingredients for certain working solutions.

It will be appreciated that the alkaline builders may preferably consist essentially of the following:

Sodium tripolyphosphate
Combinations of sodium tripolyphosphate with materials selected from the group consisting of sodium sulfate and soda ash (sodium carbonate)
Trisodium phosphate
Tetrasodium pyrophosphate
Tetrapotassium pyrophosphate
Sodium hydroxide
Nitrilotriacetic acid (NTA)
Sodium citrate
Potassium citrate as well as combinations of these materials. These materials have been found to function well. They are, of course, employed to an extent rendering it possible to elevate the pH to a preferred level of at least about 10. Lower pH solutions may be used successfully, however for most soil conditions, systems of the present invention having the higher pH's are preferred. Included in those alkaline builders set forth hereinabove are the various phosphate substitutes such as NTA or certain citrate salts such as sodium citrate or potassium citrate may be successfully utilized.

The wetting agents or surfactants which are preferred in the present systems normally are non-ionic alkylated water soluble types. When nonylphenoxypoly (ethyleneoxy) ethanol is employed, the composition has between about 8 and 16 mols of ethylene oxide on the chain. It will be appreciated that a biodegradable modified ethoxylate may also be employed, with the biodegradable feature normally requiring that a chain length of approximately 4 to 18 carbon atoms or more be present on the chain. These materials are, of course, widely available commercially. The material selected is normally compatible with anionic, non-ionic or ampholytic electrolytes.

As has been indicated, the floatation agent is not a critical component and in certain of the formulations, in particular that of Example 1, no flotation agent is required. One floatation agent which may be successfully employed is sodium alkyl aryl sulfonate, such as, for example, a structure having the following structual formula:

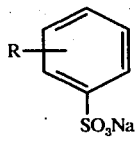

wherein R is an alkyl chain having from between about 11 and 13 carbon atoms. The material may be present in an amount ranging from between about 1 and 10% by weight of the total weight of alkaline builder, wetting agent and flocculant. This mateial is commercially available.

In certain applications, a coagulation aid such as ferric chloride, alum, fly ash, calcium chloride, ferrous sulfate, bentonite clay, Guar gum, polyethyleneoxide may be employed.

The flocculating agent is preferably polyadiallyldimethyl ammonium chloride, and it is preferred that the material have a molecular weight of about 100,000, with molecular weights of up to 300,000 being useful as well. Flocculating agents of this type having molecular weights between about 100,000 and 300,000 are commercially available. This material does not adversely affect solubility of the concentrate and thus solutions can be made without extensive blending times being required. This high molecular weight polyelectrolyte is desirable in the systems discussed above. One class of such polyelectrolytes which may be found useful in the formulations of the present invention are disclosed in U.S. Pat. No. 3,288,770 dated Nov. 29, 1966.

Generally speaking, the polyelectrolytes which are most effective are those which are capable of increasing the size of the various agglomerates of colloidal particles as well as other entrained solids which are present in the scrubbing solution on the surface being treated in order that they may be easily removed or otherwise extracted from the solution so as to leave a clarified film with most of the soilage particles removed therefrom. These individual agglomerates or flocs must have sufficient mechanical strength so that they will not be broken up or otherwise re-dispersed before ultimate separation from the solution. Furthermore, they should be sufficiently large in size so as to be easily separated by conventional filtration techniques. Furthermore, the unspent polyelectrolyte preferably has the characteristic of remaining in solution after removal of the agglomerates, so that it may be effectively utilized on subsequent recycling of the solution.

In order to provide ranges for formulations either in solution or dry form, which may be employed, the following table is given:

TABLE I

| Component | Content |
|---|---|
| An alkaline builder selected from sodium tripolyphosphate; potassium hydroxide; soda ash (light); trisodium phosphate; tetrasodium pyrophosphate; tetrapotassium pyrophosphate; sodium hydroxide; certain combinations of these builders | 5% – 75% |
| Wetting agent, preferably non-ionic type or acid-based anionic type as set forth in the Examples | 0.5% – 30% |
| Flocculant | 2% – 40% |
| Water | 0% – 90% |

It will be appreciated that the above ranges must be chosen in consideration with the overall result in that water if utilized in the concentrate should render the formulation readily soluble. Also, if one component is selected in the high range, certain other active components should reasonably be lower.

As a more specific range of workability, the following formulations, consistent with certain of the examples is provided:

TABLE II

| Component | Content |
|---|---|
| An alkaline builder selected from sodium tripolyphosphate; sodium sulfate; soda ash (light); trisodium phosphate; tetrasodium pyrophosphate; tetrapotassium pyrophosphate; sodium hydroxide; certain combinations thereof | 4% – 40% |
| Wetting agent, preferably non-ionic type or acid-based anionic type as set forth in the Examples | 0.5% – 15% |
| Floatation agent, sodium alkyl aryl sulfonate | 0% – 3% |
| Flocculant, such as polydiallyldimethyl ammonium chloride (average molecular weight 100,000 to 300,000) polyacrylamides (average molecular weight 2 –15 million), or the copolymer of dimethyl diallyl ammonium chloride and acrylamide having a molecular weight of about 1 million | 2% – 40% |
| Coagulation aid | 0% – 5% |
| water | 0% – 90% |

Consideration as to ranges to be chosen are subject to the same parameters as indicated in connection with the formulations of Table I.

The working solution contains polyelectrolyte present in a range of from between 2 and 50,000 ppm. If less than 2 ppm are present, the flocculating capability tends to be less than that desired in the solution, and if greater than 50,000 ppm are utilized, the solution may tend toward gelation. Normally, a range of between 100 and 20,000 ppm are utilized for effective performance.

If desired for cetain applications, chelating agents may be utilized as a component in the formulation. Also, perfumes and optical brighteners, as is conventional in detergent formulations, may be utilzed to enhance the results obtained.

It has been learned that a typical floor scrubber adapted for use with a standard commercially available detergent could cover a total of 68,000 square feet per 50 gallons working solution capacity on a floor which could be characterized as having light soilage present. This capability was based upon a commercial floor scrubber treating the floor on a one-pass basis. The same device, equipped with a modified or single detergent retaining tank of 50 gallon capacity and with a simple filter, and utilizing the detergent composition of the present invention (Example 1), can cover up to 228,000 square feet in a one-pass operation, this increased area being made possible by virtue of the recycling of the working solution during operation. In addition to the greater area capability, it was found that two separate passes were required with the apparatus using the standard detergent material in order to achieve a degree of cleanliness equal to that achieved with a single pass using the detergent composition of the present invention.

The liquid delivery rate for a 26-inch path is preferably in the range of about 2½ gallons per minute. This provides a film of liquid on the floor which is relatively thick, and is in the range of about 4 mils. Constant agitation of this film has been found to provide rapid and stable growth of flocs.

The recycling capability of the detergent of the present invention makes it possible for recycling to occur a substantial number of times. It will be appreciated that the number of cycles will depend primarily upon the degree of soilage encountered, however recycling of 8 to 10 times under normally encountered conditions is readily achievable. Also, for certain operations, it may be necessary to replenish the components of the detergent formulations herein, or in certain instances specifically the flocculant and floatation aid, if utilized, during recycling, since certain portions of these components are lost from the solution upon filtering.

We claim:

1. A detergent composition consisting essentially of a formulation prepared with the following composition:

| Component | Content |
|---|---|
| (a) an alkaline builder selected from the group consisting of sodium tripolyphosphate, mixtures of sodium tripolyphosphate with an alkaline agent selected from the group consisting of potassium hydroxide, sodium sulfate and sodium carbonate; trisodium phosphate, tetrasodium pyrophosphate, tetrapotassium pyrophosphate, sodium hydroxide, nitrilotriacetic acid, sodium citrate, potassium citrate and combinations thereof | 5% to 75% |
| (b) a wetting agent selected from the group consisting of a mixture of mono and polyglucosides of a mixed alcohol having from 8 to 10 carbon atoms and nonylphenoxy poly (ethyleneoxy) ethanol | 0.5% to 30% |
| (c) a flocculant selected from the group consisting of polydiallyldimethyl ammonium chloride of average molecular weight of about 100,000 and polyacrylamide of average molecular weight of between about 2 million and 15 million | 2% to 40% |

2. The detergent composition as set forth in claim 1 wherein a floatation agent consisting essentially of sodium alkyl aryl sulfonate is present in an amount ranging from between about 1% and 10% by weight of the total weight of alkaline builder, wetting agent and flocculant, said floatation agent having the structural formula:

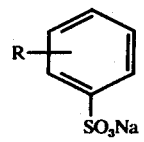

wherein R is an alkyl chain having from between about 11 and 13 carbon atoms.

3. The detergent composition as set forth in claim 1 wherein said alkaline builder is selected from the group consisting of sodium tripolyphosphate, potassium hydroxide, sodium carbonate, and combinations thereof.

4. The detergent composition as set forth in claim 1 wherein said formulation is diluted for the preparation of a working solution, and wherein said working solution contains from between about 1.5 and 20% of the detergent composition.

5. The detergent composition as set forth in claim 1 wherein said flocculant is present in said formulation in an amount ranging from between about 25 to 40% by weight of the combined weight of the alkaline builder and wetting agent present.

6. The detergent composition as set forth in claim 1 wherein said alkaline builder includes sodium tripolyphosphate present in said formulation in a range of from between about 18 and 30% by weight of the total weight of alkaline builder, wetting agent and flocculant.

7. A detergent composition consisting essentially of a formulation prepared with the following composition:

| Component | Content |
|---|---|
| (a) an alkaline builder selected from the group consisting of sodium tripolyphosphate, mixtures of sodium tripolyphosphate with an alkaline agent selected from the group consisting of potassium hydroxide, sodium sulfate and sodium carbonate; trisodium phosphate, tetrasodium pyrophosphate, tetrapotassium pyrophosphate, sodium hydroxide, nitrilotriacetic acid, sodium citrate, potassium citrate and combinations thereof | 5% to 75% |
| (b) a wetting agent selected from the group consisting of: (1) a mixture of mono and polyglucosides of a mixed alcohol having from 8 to 10 carbon atoms; and (2) an ethoxylate selected from the group consisting of nonylphenoxypoly (ethyleneoxy) ethanol and an anionic modified ethoxylate | |

-continued

| Component | Content |
|---|---|
| having a chain length with from 4 to 18 carbon atoms present along the length thereof | 0.5% to 30% |
| (c) a flocculant selected from the group consisting of polydiallyl-dimethyl ammonium chloride of average molecular weight of between about 100,000 and 300,000, polyacrylamide having an average molecular weight of between about 2 million and 15 million, and the copolymer of dimethyl diallyl-ammonium chloride and acrylamide having a molecular weight in excess of about 1 million | 2% to 40% |

8. The detergent composition as set forth in claim 7 wherein a floatation agent consisting essentially of sodium alkyl aryl sulfonate is present in an amount ranging from between about 1 and 10% by weight of the total weight of alkaline builder, wetting agent and flocculant, said floatation agent having the structural formula:

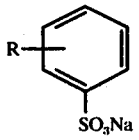

wherein R is an alkyl chain having from between about 11 and 13 carbon atoms.

9. The detergent composition as set forth in claim 7 wherein said alkaline builder is selected from the group consisting of sodium tripolyphosphate, potassium hydroxide, sodium carbonate, and combinations thereof.

10. The detergent composition as set forth in claim 7 wherein said formulation is diluted for the preparation of a working solution, and wherein said working solution contains from between about 1.5 and 20% of the detergent composition.

11. The detergent composition as set forth in claim 7 wherein said flocculant is the copolymer of dimethyl diallyl-ammonium chloride and acrylamide with a molecular weight of about 1 million, with said flocculant being present in said formulation in an amount of about 14%.

* * * * *

UNITED STATES PATENT OFFICE

CERTIFICATE OF CORRECTION

PATENT NO. : 4,014,808

DATED : March 29, 1977

INVENTOR(S) : Ferdinand J. Herpers, Jr. and Daniel I. Untiedt

It is certified that error appears in the above-identified patent and that said Letters Patent are hereby corrected as shown below:

Column 1, line 35, "by" should read -- be --. Line 58, "spend" should read -- spent --.

Column 10, line 62, after the word "soils" insert -- which may be encountered in order to render them more --.

Column 11, line 67, "among" should read -- Among --.

Column 13, line 48, "polyadiallyl-" should read -- polydiallyl- --.

Column 15, line 6, "utilzed" should read -- utilized --.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*